US009454897B2

(12) United States Patent
Cattermole et al.

(10) Patent No.: US 9,454,897 B2
(45) Date of Patent: Sep. 27, 2016

(54) RV WIRELESS REMOTE CONTROL

(71) Applicant: Innovative Design Solutions, Inc., Troy, MI (US)

(72) Inventors: David Cattermole, Oakland Township, MI (US); Matt Collin, Ferndale, MI (US); Robert Ford, Troy, MI (US); John P. Manfreda, St. Clair Shores, MI (US); Mark Woloszyk, Oakland Township, MI (US)

(73) Assignee: Innovative Design Solutions, Inc., Troy, MI (US)

( * ) Notice: Subject to any disclaimer, the term of this patent is extended or adjusted under 35 U.S.C. 154(b) by 324 days.

(21) Appl. No.: 14/167,523

(22) Filed: Jan. 29, 2014

(65) Prior Publication Data

US 2014/0210593 A1 Jul. 31, 2014

Related U.S. Application Data

(60) Provisional application No. 61/849,594, filed on Jan. 29, 2013, provisional application No. 61/782,920, filed on Mar. 14, 2013.

(51) Int. Cl.
*G08C 17/02* (2006.01)

(52) U.S. Cl.
CPC ..... *G08C 17/02* (2013.01)

(58) Field of Classification Search
CPC ... G08C 17/02; F16C 1/105; A61G 2203/12; A61G 7/018; E05B 53/00
USPC ..... 701/2; 340/5.61, 12.5, 12.22, 539.1, 340/425.13, 426.16, 426.17, 13.24; 455/419; 414/462
See application file for complete search history.

(56) References Cited

U.S. PATENT DOCUMENTS

| | | | | |
|---|---|---|---|---|
| 4,505,643 | A | 3/1985 | Millis et al. | |
| 4,776,415 | A | 10/1988 | Brice | |
| 5,143,386 | A | 9/1992 | Uriarte | |
| 6,142,501 | A | 11/2000 | Fogo et al. | |
| 6,300,734 | B1 | 10/2001 | Franke et al. | |
| 6,885,924 | B2 | 4/2005 | Ford et al. | |
| 6,900,603 | B1 | 5/2005 | Del Vecchio | |
| 7,199,534 | B2 | 4/2007 | Ford et al. | |
| 2003/0089296 | A1 | 5/2003 | Haynes | |
| 2008/0299961 | A1 * | 12/2008 | Muller | G08C 17/02 455/419 |

(Continued)

OTHER PUBLICATIONS

Control All Wireless internet ad, www.controllallwireless.com, Sep. 15, 2009, 2 pages.

(Continued)

*Primary Examiner* — Marthe Marc-Coleman
(74) *Attorney, Agent, or Firm* — Reising Ethington P.C.

(57) ABSTRACT

An RV wireless remote control system comprising an HMI including a GUI coupled to an HMI RF transceiver and an HMI dock connector. The HMI RF transceiver receives RV device status signals over an RF fieldbus and the HMI dock connector receives RV device status signals over an RV localbus. The HMI generates control signals in response to the status signals and/or operator input signals. The HMI transmits the control signals to the RV devices over the RF fieldbus via the HMI RF transceiver or over the RV localbus via the HMI dock connector when the HMI dock connector is connected to the RV localbus. The HMI is configured for real time distributive control of the RV devices such that the RV localbus and the RF fieldbus operate in both directions enabling closed-loop control between the HMI and the RV devices.

20 Claims, 9 Drawing Sheets

(56) References Cited

U.S. PATENT DOCUMENTS

2010/0209222 A1* 8/2010 Collins ..... B60P 3/07
414/462

OTHER PUBLICATIONS

Control All Wireless internet ad, www.controllallwireless.com, RF-600DC Wireless Variable Speed DC Motor Controller, Sep. 15, 2009, 5 pages.

Wireless Remote Controlled Electric Jack by Rieco Titan Products Inc. internet ad, 2009; 2 pages.

Universal Remote Control: Remote: RV Jacks & Levelers: RV Parts Store, internet ad for Universal Remote Control #8252, Berryland Campers RV Parts Online, 2009, 2 pages.

Maxx Air MaxxFan Roof Vent System, internet ad, 2009, 4 pages.

Awing Systems and Electronics, RV ACMC RV Awning Controller—Girard RV Awnings, internet ad, 2009, 2 pages.

* cited by examiner

1. Gateway connects to internet and share with HMI
2. HMI receives firmware updates from product website
3. HMI self updates it's own firmware
4. HMI uses gateway to transmit firmware updated to other devices on the local bus

RV WIRELESS REMOTE CONTROL

CROSS-REFERENCES TO RELATED APPLICATIONS

This application claims the benefit of provisional patent application Ser. No. 61/849,594 filed Jan. 29, 2013 and provisional patent application Ser. No. 61/782,920 filed Mar. 14, 2013.

STATEMENT REGARDING FEDERALLY SPONSORED RESEARCH OR DEVELOPMENT

Not Applicable

BACKGROUND

1. Field

This invention relates generally to remote control of remote-control-enabled electrical devices installed in Recreational Vehicle (RV) systems.

2. Description of Related Art Including Information Disclosed Under 37 CFR 1.97 and 1.98

RVs include onboard systems that are intended to enhance the quality of the RV traveling/living experience. Some RV onboard systems are remotely controllable via hard-wired electrical circuits.

SUMMARY

An _RV wireless remote control system is provided, which comprises a Human-Machine Interface (HMI) including an HMI RF receiver, an HMI dock connector, and a Graphic User Interface (GUI) coupled to both the HMI RF transceiver and the HMI dock connector. The GUI is configured to generate signals in response to human inputs to the GUI and/or in response to status signals received from other devices connected to a local RV wired network and/or to an RF fieldbus. The HMI RF transceiver is configured to receive RV device status signals over a wireless connection from an RF fieldbus when the HMI dock connector is not connected to the RV localbus. The HMI dock connector is configured to receive RV device status signals over a wired connection from the RV localbus when the HMI dock connector is connected to the RV localbus. The HMI is configured to generate control signals in response to human operator input signals received via the GUI, and to transmit the control signals to the RV devices over the RF fieldbus via the HMI RF transceiver when the HMI dock connector is not connected to the RV localbus, and over the RV localbus via the HMI dock connector when the HMI dock connector is connected to the RV localbus. The HMI is further configured for real time distributive control of the RV devices such that the RV localbus and the RF fieldbus operate in both directions enabling closed-loop control between the HMI and the RV devices.

DRAWING DESCRIPTIONS

These and other features and advantages will become apparent to those skilled in the art in connection with the following detailed description and drawings of one or more embodiments of the invention, in which.

Figure 5:
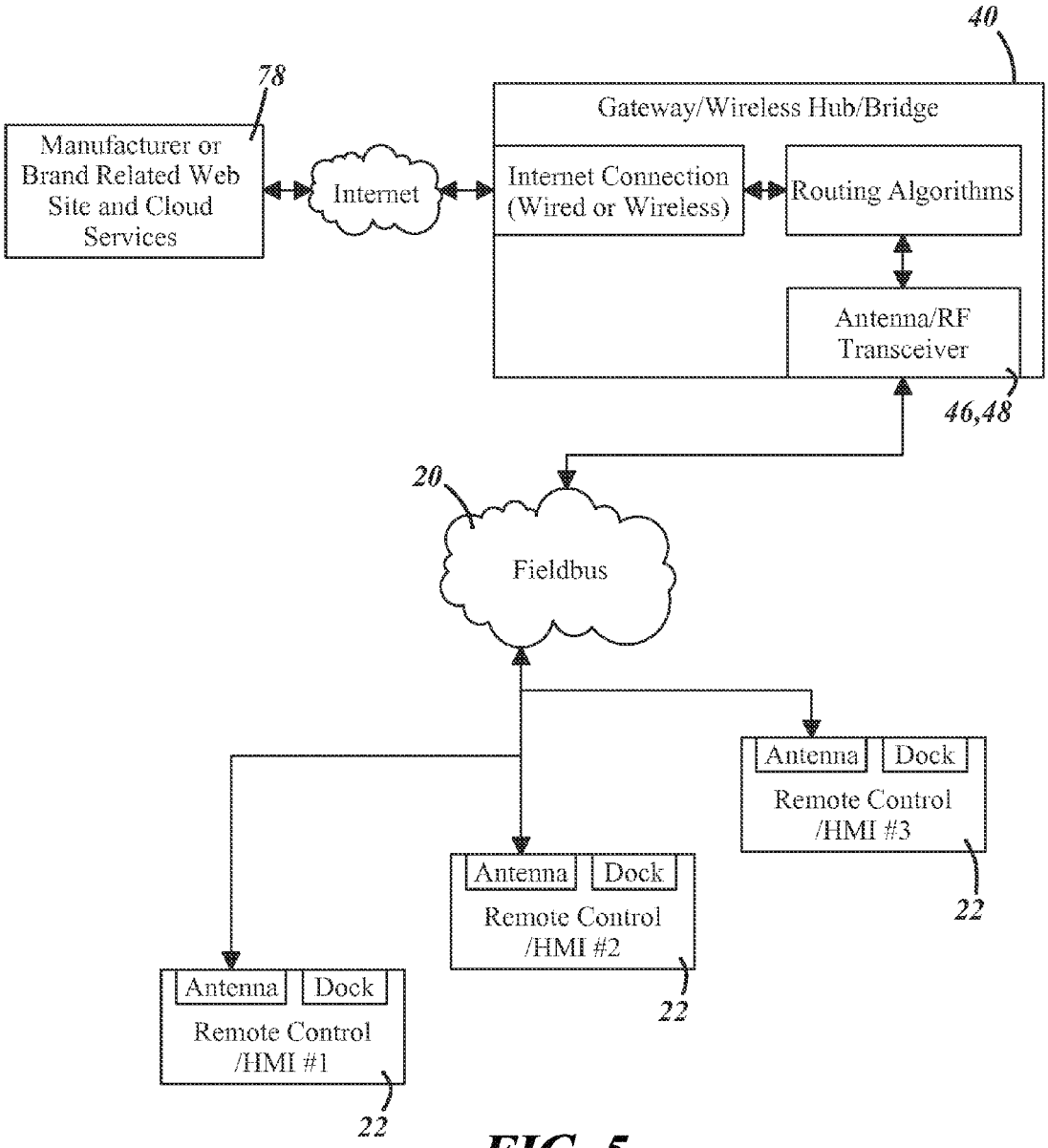
FIG. 5 is a schematic block diagram showing a connection of a gateway module of the RV wireless control system of FIGS. 1 and 2A-C to the internet enabling the sharing of information between an HMI of the system and a manufacturer or brand-related web site.
Figure 6:
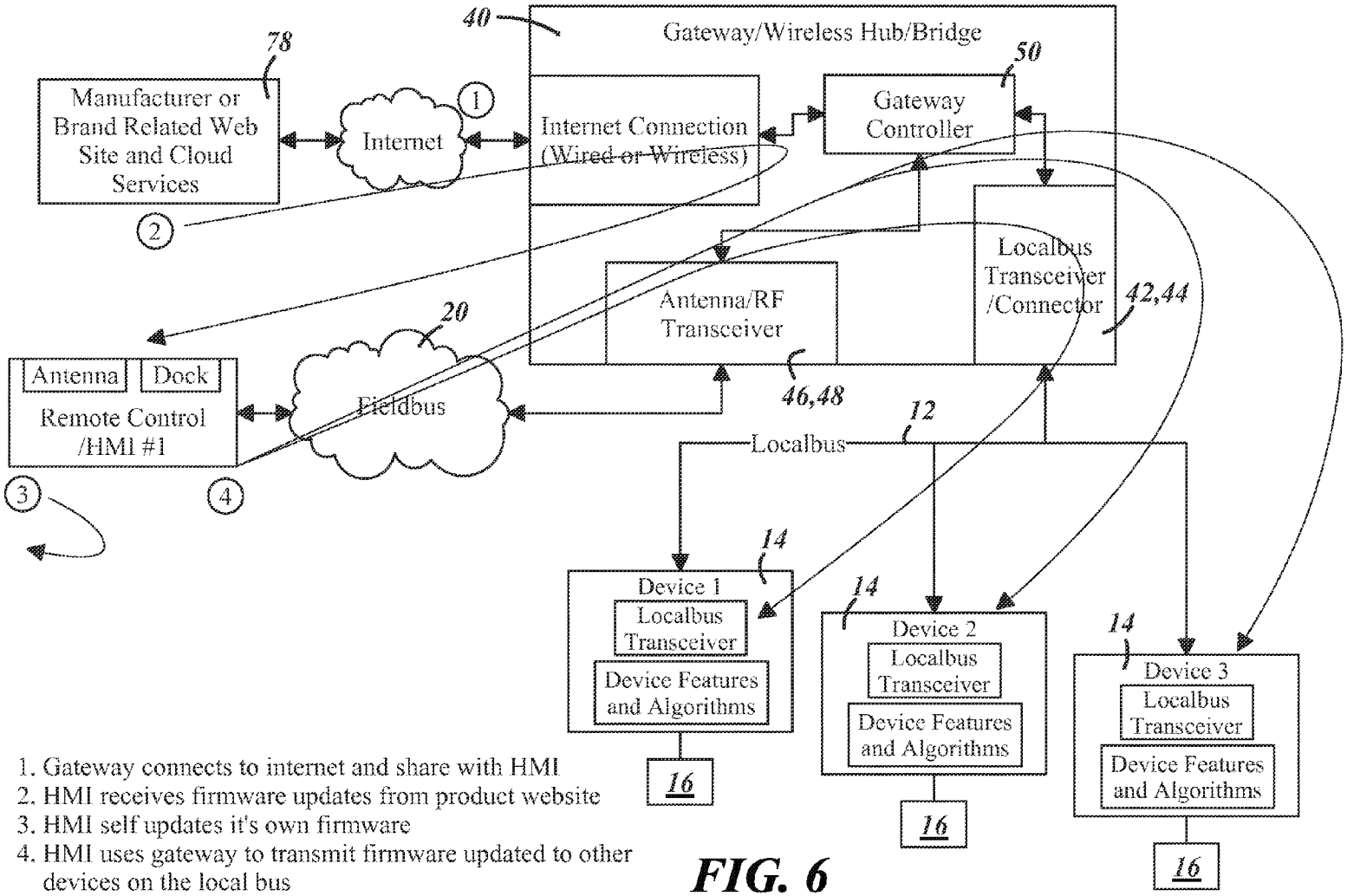
Figure 7:
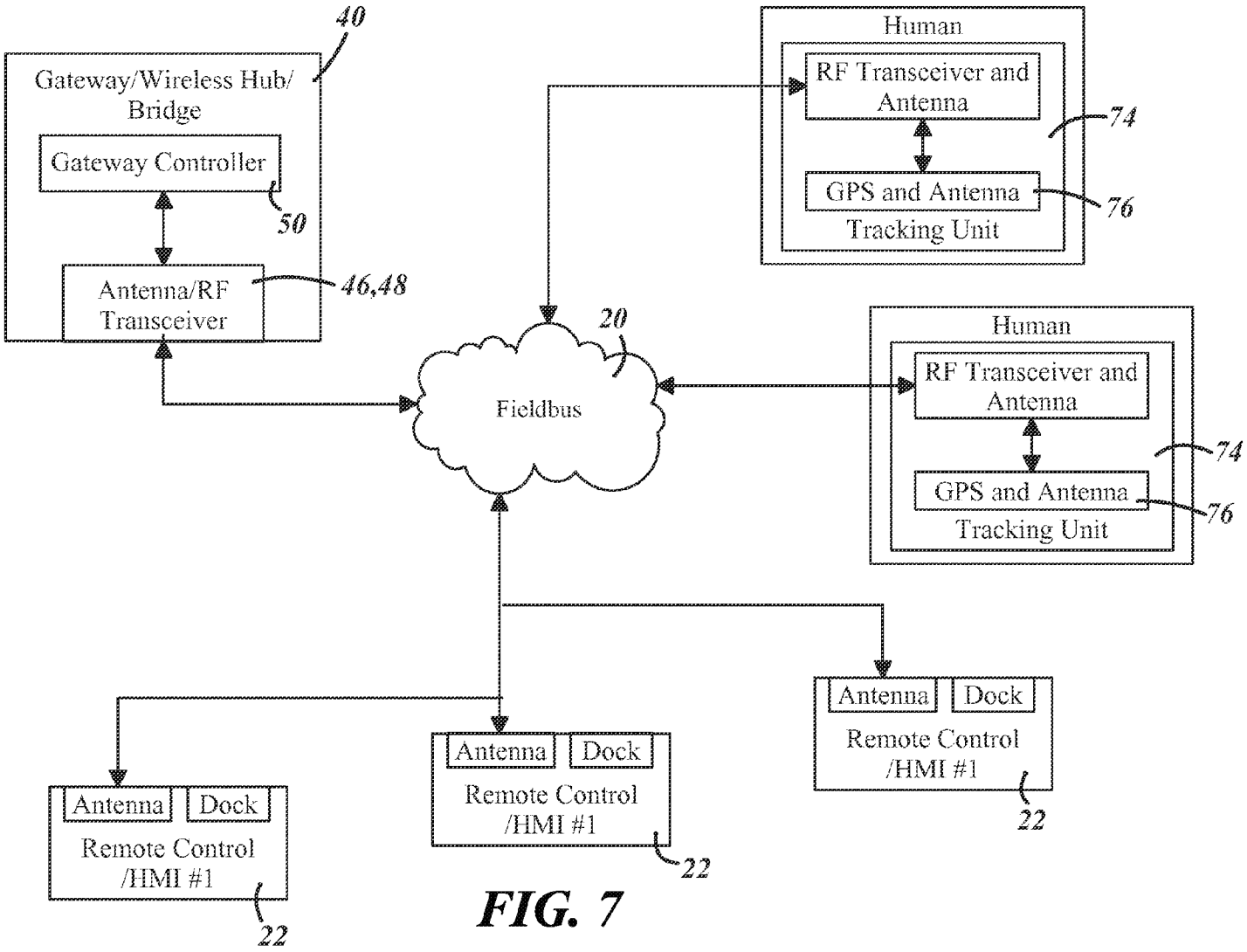

FIG. 6 is a schematic block diagram showing the use of the connection of FIG. 5 to enable firmware updates to an HMI and RV localbus devices of the RV wireless control system of FIGS. 1 and 2A-C; and FIG. 7 is a schematic block diagram showing the use of the RV wireless control system of FIGS. 1 and 2A-C to track persons carrying personal tracking devices having GPS self-tracking capability and configured to connect to one or more HMIs of the system via an RF fieldbus and the gateway module of the system.

DETAILED DESCRIPTION OF INVENTION EMBODIMENT(S)

Figure 1:
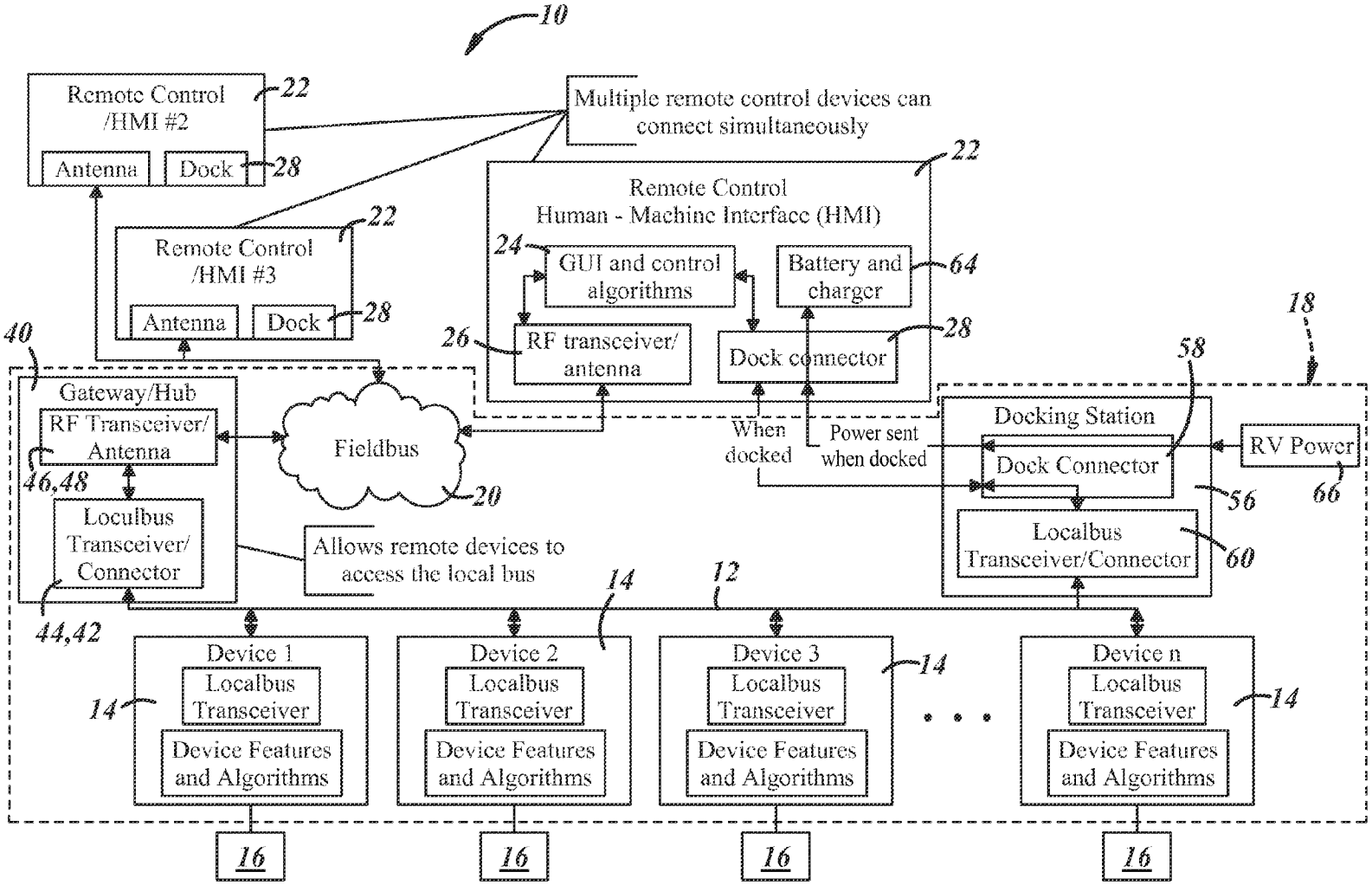
FIG. 1 is a schematic block diagram of an RV wireless remote control system.

An RV wireless remote control system for remote control of remote-control-enabled electrical devices such as, for example electronic, electro-motive, and/or sensing devices, which are involved in operating RV onboard systems, is shown at 10 in FIG. 1.

As shown in FIG. 1, the RV wireless remote control system 10 may comprise a local RV wired network (RV localbus) 12 connectable to one or more network-enabled, remote-control-enabled electrical devices (RV devices) 14 connected to and configured to operate respective onboard systems 16 of an RV 18 (onboard RV systems 16). The network topology of the RV localbus 12 may be in accordance with the CAN standard or, in other embodiments, may employ Ethernet technology.

As shown in FIG. 1, the remote control system 10 may also comprise an RF fieldbus 20 wirelessly couplable to the RV localbus 12. The RF fieldbus 20 may be a local wireless RF network, e.g., an 802.11 "WiFi®" network.

Figure 2A:
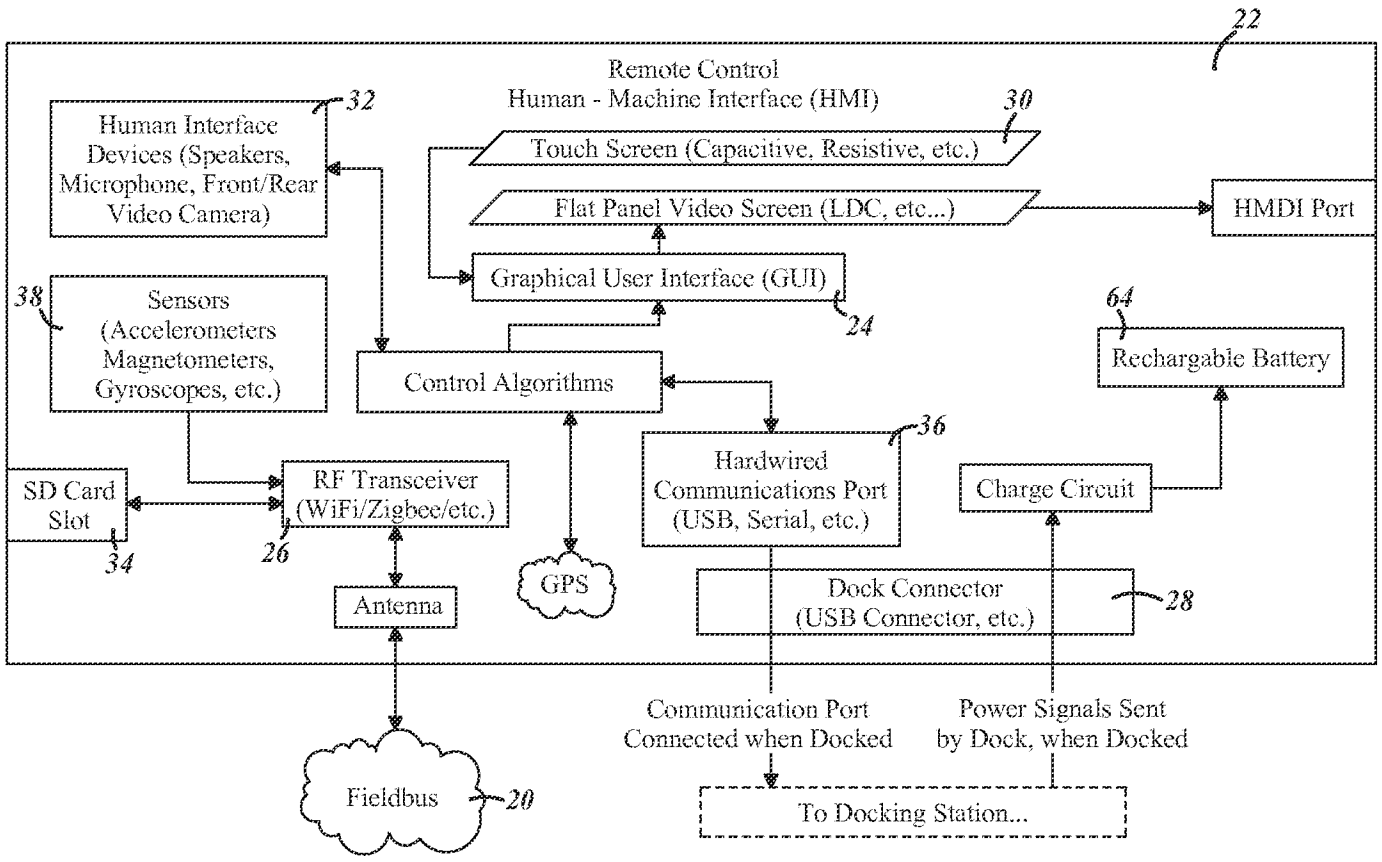
FIG. 2A is a more detailed schematic block diagram of the RV wireless remote control system of FIG. 1.

As best shown in FIG. 2A, the remote control system 10 may further include one or more remote control Human-Machine Interfaces 22 (HMIs), each such HMI 22 comprising a Graphic User Interface 24 (GUI), an HMI RF transceiver 26, and an HMI dock connector 28. One or more of the HMIs 22 may also comprise a capacitive touch screen 30, ZigBee® capability, Bluetooth® capability, WiFi® capability, 315 MHz capability, docking station support, human interface devices 32 (forward and rear facing cameras, a speaker, a microphone), an SD card slot 34, a USB connection 36 for recharging, and/or sensors 38 such as an accelerometer and/or gyroscope for tracking and dead reckoning. Although the present embodiment employs WiFi®, in other embodiments any other suitable communications system may be used.

As shown in FIGS. 1 and 2A, the GUI 24 of each HMI may be electrically coupled to both its HMI fieldbus RF transceiver 26 and its HMI dock connector 28. The HMI 22 may be configured to generate signals in response to human inputs to its GUI 24, and/or in response to device status messages received by the HMI 22 from the RV devices 14 over the RV localbus 12 and/or the RF fieldbus 20. The HMI fieldbus RF transceiver 26 of each HMI 22 may be configured to receive RV device status signals via a wireless connection from the RF fieldbus 20 when its HMI dock connector 28 is not connected to the RV localbus 12, and the HMI dock connector 28 of each HMI 22 may be configured to receive RV device status signals via a wired connection from the RV localbus 12 when its HMI dock connector 28 is connected to the RV localbus 12.

Each HMI 22 may be configured to generate control signals in response to human operator input signals received via its GUI 24, and to transmit the control signals to other devices on any wired or wireless network to which the HMI 22 has access, e.g., to the RV devices 14, over the RF fieldbus 20 via the HMI fieldbus RF transceiver 26 of the HMI 22 when the HMI's dock connector 28 is not connected to the RV localbus 12, and over the RV localbus 12 via the HMI's dock connector 28 when the HMI's dock connector 28 is connected to the RV localbus 12. One or more of the HMIs 22 may be further configured for real time distributive control of the RV devices 14 such that the RV localbus 12 and the RF fieldbus 20 operate in both directions enabling closed-loop control between each HMI 22 and the RV devices 14. When the RF fieldbus 20 provides a bridge between the RV localbus 12 and RV devices 14 on the RV localbus 12, enabling closed-loop control between each HMI 22 and other RV devices 14 on the network.

As best shown in FIG. 1, the RV devices 14 may be connected to and configured to control respective onboard RV systems 16. The RV devices 14 may be network-enabled in the sense that they may be network capable and remote controllable over a network. The RV devices 14 may comprise one or more leveler controls for controlling one or more RV levelers, one or more room slide-out controls for controlling one or more slide-outs, one or more TV lift controls for controlling one or more TV lifts, one or more fireplace controls for controlling one or more fireplaces, one or more awning controls for controlling one or more awnings, one or more air vent and/or fan controls (bathroom vent for example) for controlling air vents and/or fans, a tire pressure monitoring system (TPMS), a solar power management system, one or more water or fuel tank level monitors, one or more water heater controls for controlling one or more water heaters, one or more water pump controls for controlling one or more water pumps, various internal and external lighting controls for controlling interior and exterior RV lighting, one or more motorized door controls for controlling the opening and closing of one or more doors, one or more door lock controls for controlling the locking and unlocking of one or more doors, one or more bed lift controls for controlling one or more beds, one or more landing gear/stabilizer jack controls for controlling landing gear and/or stabilizer jacks, a rear view backup camera control for controlling a backup camera, one or more chassis gateway controls for obtaining and displaying vehicle speed, rpm, etc. information, an electronic compass heading sensor, one or more electrical generator controls for controlling an electrical generator, one or more air conditioning system controls for controlling an RV heating and/or air conditioning system, one or more stove-top lift controls, one or more furnace controls for controlling a furnace, one or more stove controls for controlling the operation and/or monitoring the status of a stove, one or more refrigerator controls and/or status monitors, one or more chassis air bag controls for controlling chassis air bags, one or more motorized step controls for controlling deployment and stowage of one or more RV steps, one or more RV power distribution controls configured to enable/disable RV power systems, and/or one or more shore power or recharge controls.

Figure 2B:
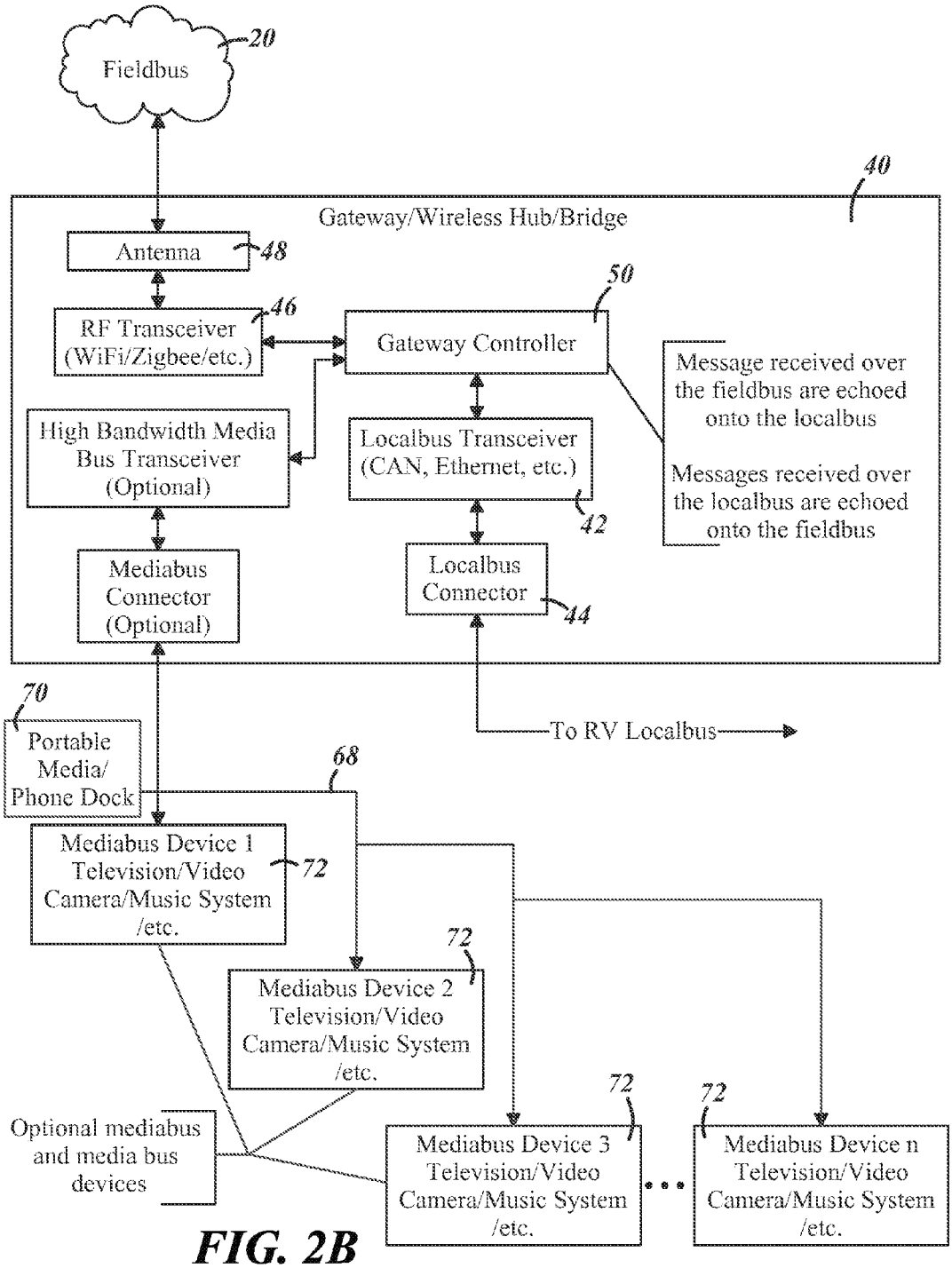
FIG. 2B is a continuation of FIG. 2A.

As best shown in FIG. 2B, the RV wireless remote control system 10 may include a communications gateway module 40 that includes a gateway localbus transceiver 42 coupled to the RV localbus 12 via a hardwired connection 44 such as a localbus connector, a gateway fieldbus RF transceiver 46 coupled to the RF fieldbus 20 via an antenna 48, and a gateway controller 50 coupled to the gateway localbus transceiver 42 and the gateway fieldbus RF transceiver 46. The gateway controller 50 may be programmed to use bridge/routing algorithms to forward onto the RF fieldbus 20 messages received over the RV localbus 12, and to forward onto the RV localbus 12 messages received over the RF fieldbus 20. The gateway controller 50 may thus be configured to route control signals received via the gateway RF transceiver 46 from one or more of the HMIs 22, to one or more of the RV devices 14 via the gateway localbus transceiver 42.

The communications gateway module 40 passes messages between the fieldbus 20 and the local electrical RV bus (RV localbus 12). In other words, the communications gateway module 40 is configured to act as an RF gateway to the local electrical RV bus. As shown in FIG. 2B, the gateway module 40 bridges both networks and causes traffic from one network to show up on the other. Devices on the fieldbus 20 can, therefore, see traffic from the localbus 12, and devices on the localbus 12 can see traffic from the fieldbus 20. The communications gateway module 40 may be configured for WiFi® capability, Bluetooth® capability, ZigBee® capability, 315 MHz capability, or any other suitable communication means, CAN bus support, GPS support, high bandwidth custom media bus support, HDMI support, and/or ethernet support and other bus support such as, but not limited to support of ISO9141, RS232, RS485, etc.

As best shown in FIG. 1, the communications gateway module 40, RF fieldbus 20, RV localbus 12, and RV devices 14 may be carried by a recreational vehicle (RV) 18 and the RV devices 14 may connect to, and operate respective RV onboard systems 16 in response to commands initiated by operator inputs to the one or more HMIs 22 and transmitted to the RV devices 14 via either the RV local bus 12 and/or the RF fieldbus 20. The RV devices 14 may also operate respective RV onboard systems 16 in response to direct operator inputs as well as in response to commands initiated by operator inputs to the one or more HMIs 22 via any suitable means such as but not limited to inputs received locally on the RV 18 through direct electrical connections such as, for example, a switchpad mounted on a wall of the RV 18. In other words, the one or more HMIs 22 may be configured to work alongside direct-wired switches.

Figure 2C:
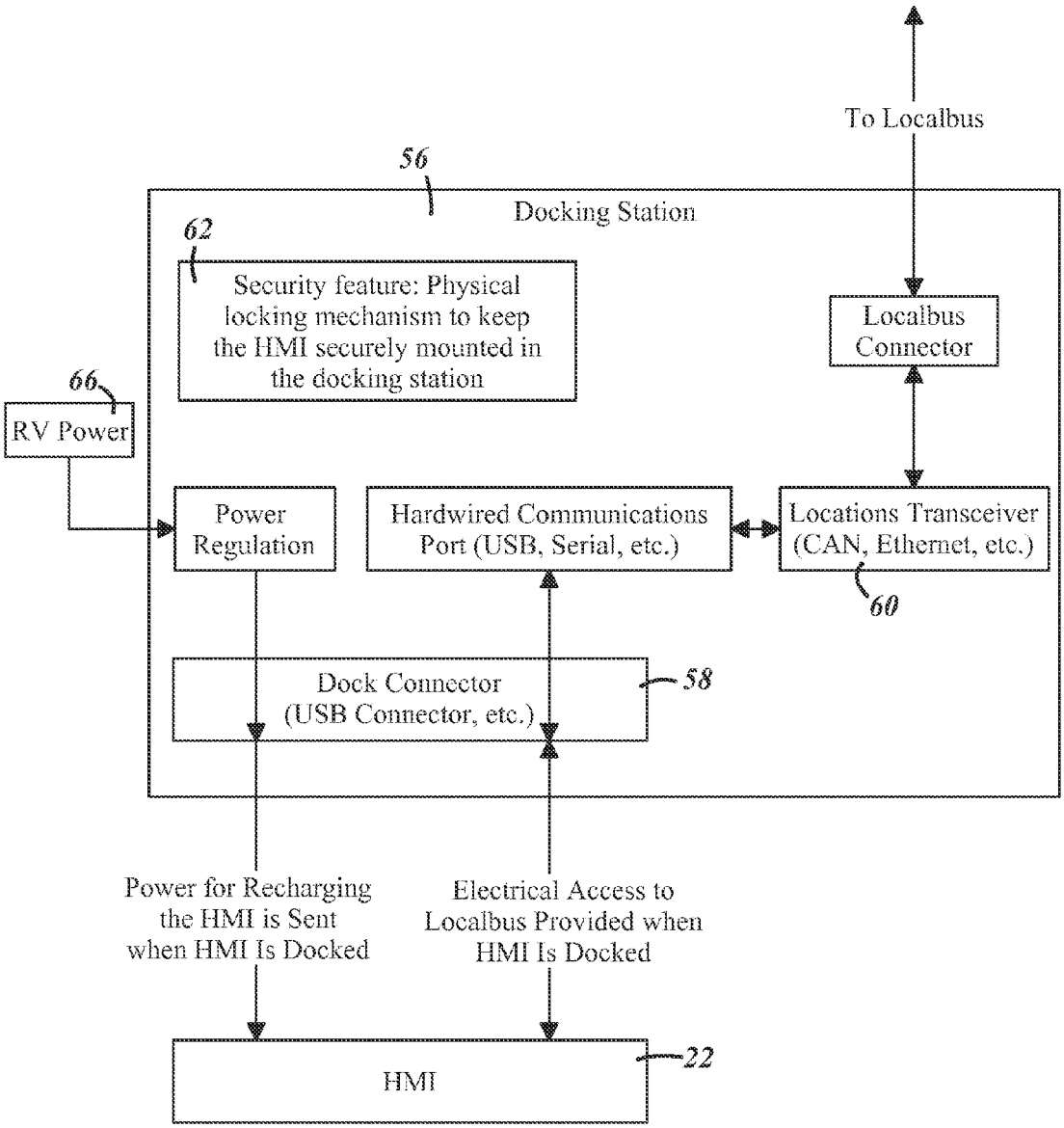
FIG. 2C is a continuation of FIGS. 2A and 2B.

As best shown in FIG. 2C, the RV wireless remote control system 10 may include any suitable docking arrangement for the one or more HMIs such as, for example, a docking station 56 that may be mounted in or to a wall of an RV 18. The docking station 56 may be configured to provide a hard-wired electrical connection between any one of the one or more HMIs 22 and the RV localbus 12 when the HMI 22 is docked in the docking station 56. The docking station 56 may include a docking station dock connector 58 that is electrically connectable to the HMI dock connector 28, and a docking station localbus transceiver 60 coupled between the docking station dock connector 58 and the RV localbus 12 to provide a hard-wired data connection between the docked HMI 22 and the RV localbus 12 when the HMI 22 is docked in the docking station 56 and the HMI dock connector 28 is electrically connected to the docking station dock connector 58. The docking station 56 thus provides a hard-wired direct electrical connection to the RV localbus 12. The docking station 56 may further comprise a security feature, such as a key operated lock 62 configured to secure at least one of the one or more HMIs 22 to the docking station 56 to preclude theft or other unauthorized removal of a docked HMI 22 from the docking station 56.

Each of the one or more of HMIs 22 may include a rechargeable battery 64 as a source of electrical power as shown in FIG. 2A. FIG. 2C, however, shows that the HMI docking station 56 may be connected to an electrical power source 66 such as an electrical power system of the RV 18 so that the battery 64 of an HMI 22 can be recharged by the electrical power source 66 when the HMI 22 is docked in the docking station 56.

As shown in FIG. 2B, the gateway module 40 may be connected to one or more additional secondary electrical buses 68, such as a high bandwidth media bus. Such a bus 68 may be connected to a portable media player dock 70 and/or one or more media bus devices 72 such as a radio control, a TV control, a speaker control, a portable camera control, and/or a webcam control. The RV wireless remote control system 10 may thus be configured to allow users to control entertainment systems such as portable media players and one or more playback devices.

As shown in FIG. 5, the RV wireless remote control system 10 may include at least one personal tracking unit 74 configured to report its location and, therefore, the location of whatever person is carrying it, to the RV wireless remote control system 10. The personal tracking unit 74 may communicate directly with the gateway module 40 with the data being shared on the localbus 12. The personal tracking unit 74 may comprise tracking unit sensors 76 which may include a GPS, a compass, and an accelerometer, and/or magnetometer to provide tracking and/or dead reckoning functions to the bearer and/or to provide the RV wireless remote control system 10 with information necessary to track the location and movements of the bearer.

Figure 3:
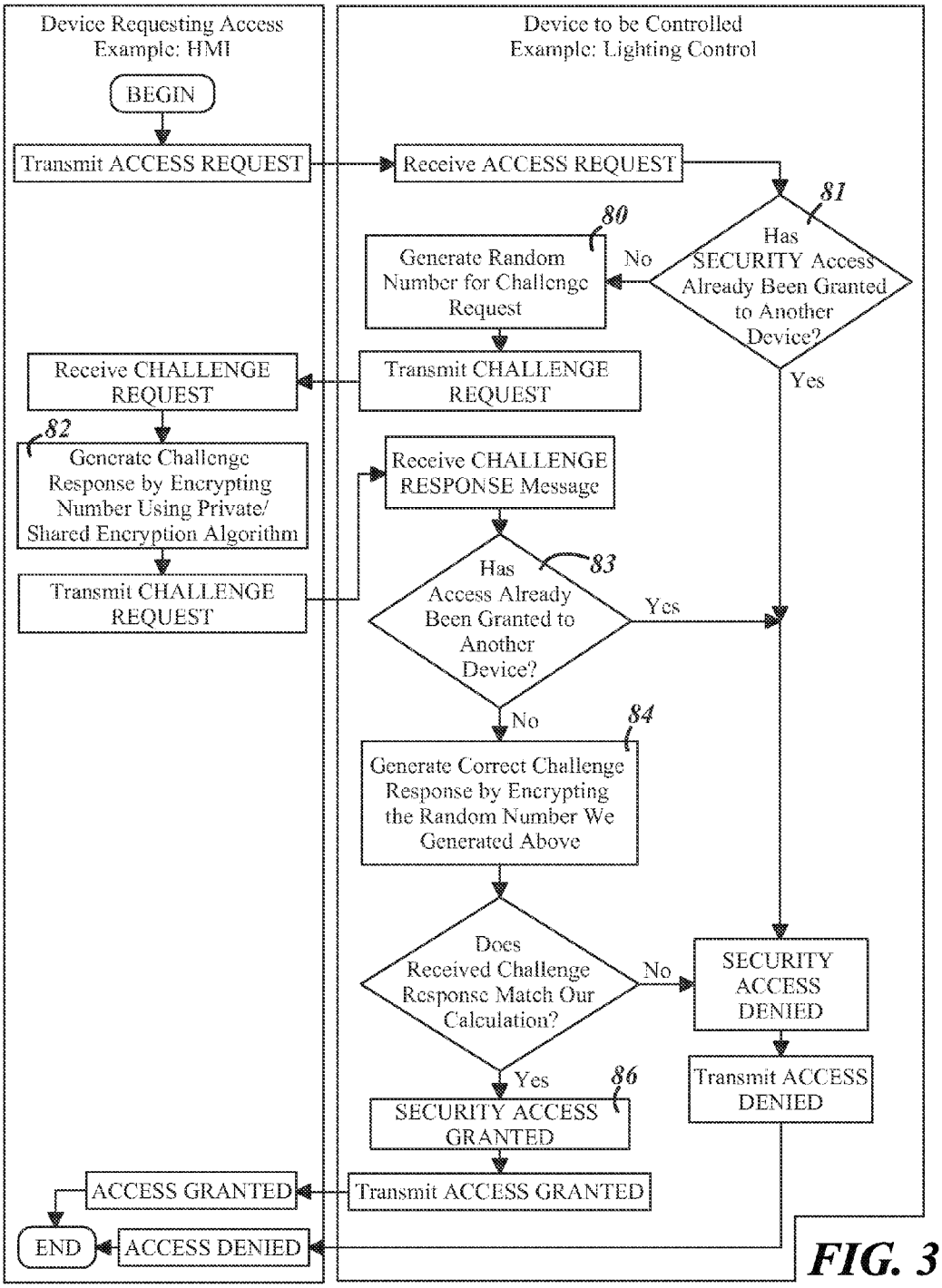
FIG. 3 is a flow chart showing a procedure for ensuring that only one remote control device (HMI) of the RV wireless control system of FIGS. 1 and 2A-C can access an RV localbus device of the system at a time.
Figure 4:
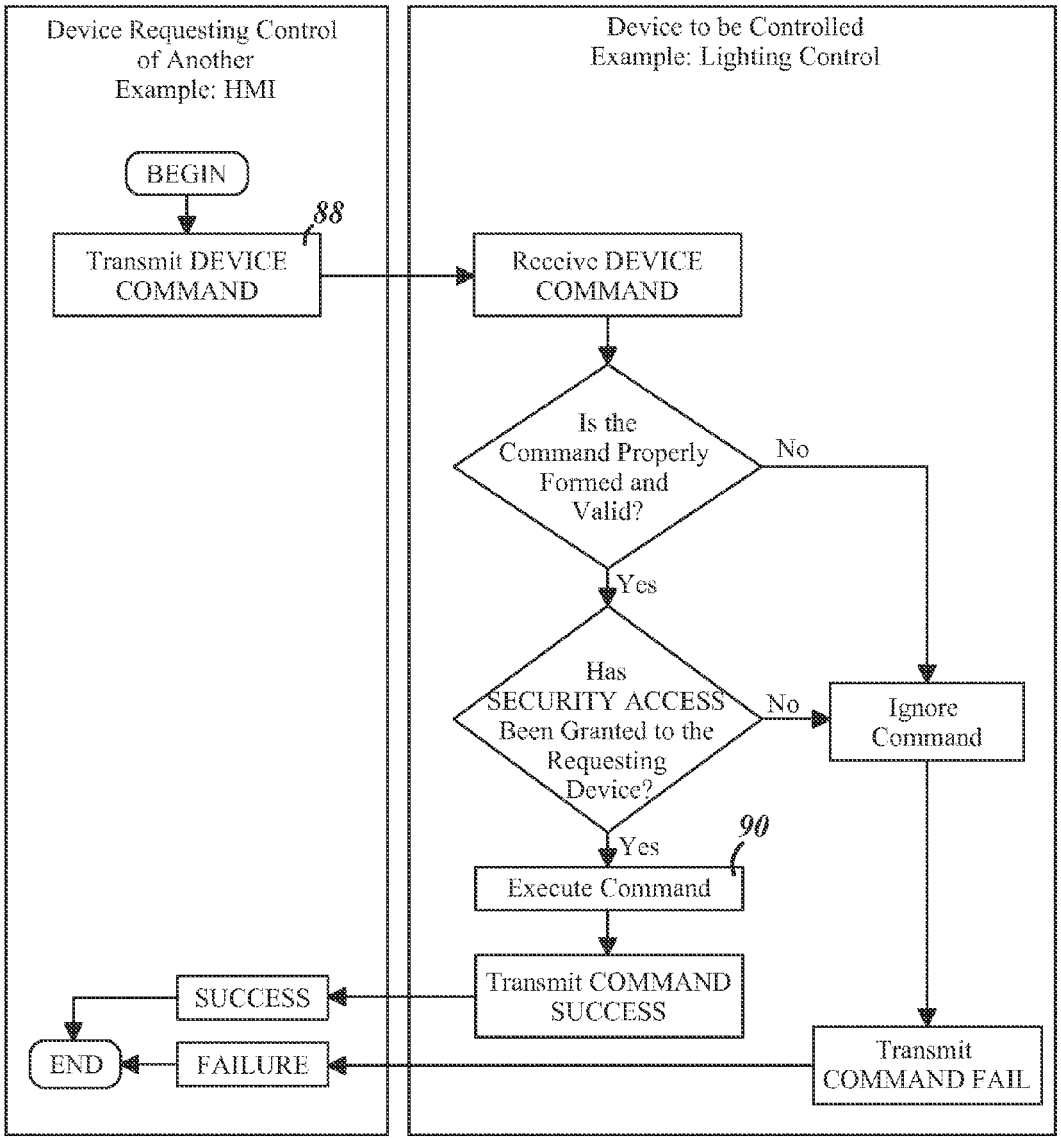
FIG. 4 is a flow chart showing a procedure for controlling security access of one device, such as an HMI of the RV wireless control system of FIGS. 1 and 2A-C, to another device, such as an RV localbus device of the system.

The gateway module 40 may be used to provide centralized control of all components in an RV 18, and may support apps that allow any type of HMI 22, e.g., a standard smart phone or tablet device, to have partial and/or full control of any number of RV onboard systems 16. As shown in FIG. 3, the RV wireless remote control system 10 may also support internet as a pass-through to RV devices 14 for the control of RV onboard systems 16, and may serve as a gateway between the internet and any one or more of the HMIs (through the fieldbus 20) and any one or more of the RV devices 14 (through the RV localbus 12), allowing HMIs 22, RV devices 14, and/or RV onboard systems 16 to be updated or to update themselves over the internet. This arrangement may also allow users to access manufacturer or brand-related web and cloud services 78 such as online tech support through the RV wireless remote control system 10 using an HMI touch screen 30 (or other compatible) interface, and to allow online tech support to access HMIs 22 and RV devices 14. The manufacturer or brand-related web and cloud services 78 may also include an app market to purchase software upgrades and unlock additional features. All apps and products may be encrypted and signed by brand owners to allow for the detection and the lockout or placement of limitations on "non-approved" aftermarket parts and products. The HMI 22 may be programmed to display popups or other indicators to alert a user to the presence of an unauthorized product.

The RV wireless remote control system 10 as shown in FIG. 3 may thus be configured to provide an RV brand-specific "online/web experience" via manufacturer or brand-related web and cloud services 78, which bring other users of a company's products together to interact with the RV manufacturer and with each other socially, to build brand identity and loyalty. Thus configured, the RV wireless remote control system 10 may also allow for the location of other RV owners and operators in the area with similar coaches or interests, trip destinations, and my further allow for local sites and sights of interest to be rated and shared with other RV owners and operators.

The RV wireless remote control system 10 may also allow GPS and internet resources to be accessed for navigation assistance and trip planning, and may be configured to provide a "flight recorder" feature that records when and/or how the RV 18 was used and/or where it has been. The GPS may also be used to locate and suggest nearby maintenance and service centers. The RV wireless remote control system 10 could also be arranged to allow a user to use GPS features to locate panels and storage compartments on a blueprint/diagram/map of the coach and its OEM features.

The RV wireless remote control system 10 may also provide predictive fault detection, resource management, and/or maintenance functions. For example: The system 10 may include an automated maintenance schedule calendar that reminds a user when maintenance is required and keeps a log of completed repairs, service, and upgrades. Vehicle maintenance history and other info may alternatively be stored online in a "cloud" storage system included in the manufacturer or brand-related web and cloud services 78 accessible to the RV wireless control system 10. The system 10 may also be programmed with one or more diagnostic programs that allow the system 10 to "phone home" to report faults and thus aid in predictive fault detection in such a way as to allow problems to be identified before they become an issue to the user.

Resource management functions of the RV wireless remote control system 10 may include smart sleep features to allow the user to schedule when the RV 18 will not be in use and to then force all remotely controlled components into a low power mode, and/or switch off RV power systems. The system 10 may also include an auto shutoff feature that deactivates onboard systems 16 such as RV heating/cooling systems when users are not inside the vehicle. By analyzing use patterns, the RV wireless remote control system 10 may also attempt to predict when water will be low, or when grey or black water tanks will be full, and automatically report the resulting estimates—as well as the current levels—to the user. Internet, weather, and GPS location data may allow the RV wireless remote control system 10 to predict when solar power will be available, and to predict usage for the day based on history. This feature can help the user plan how to use various onboard RV systems 16 within the constraints of battery capacity and expected sunlight for the day.

Safety features incorporated into the RV wireless remote control system 10 may include "daughter" modules that allow the RV wireless remote control system 10 to track the location of people/kids/pets/keys. The central gateway module 40 may store setting info for the daughter controllers, allowing the daughter controllers to be replaced without losing settings. Certain features, such as leveling, slideouts, may be disabled if "kid-tracking" reports someone or something in a hazardous area. Critical manual or remote controls may be disabled unless an authorized remote is nearby. To prevent unauthorized entry, RV systems 16 such as, for example, a motorized step, may be programmed to operate only when "tracked" owners are near the vehicle. The RV wireless remote control system 10 may further be configured to detect when two or more remotes are in use simultaneously and may be configured to ensure that only one remote at a time has full control. The system 10 may be configured to allow users to terminate other connections as necessary but may be programmed to give preference to the first remote when multiple remotes attempt to access a shared feature.

As shown in FIGS. 6 and 7, the RV wireless remote control system 10 may be configured to encrypt communications to prevent outside tampering with the system 10 and to ensure that RV devices 14 are controlled in a secure and safe manner. The system 10 may be configured such that only one of the one or more HMIs 22 can be in control of any given RV device 14 at any one time. It would, for example, be undesirable if two HMIs 22 could simultaneously be used to control the same onboard RV system such as an RV slideout. To prevent this kind of contention and conflict between HMIs 22, encryption may be used to ensure "first come-first served" operation, which ensures that only one HMI 22 is controlling any one RV device 14 at any one time—making it impossible for two or more HMIs 22 to control the same RV device 14 at the same time. In addition, or optionally, encryption may be used to make it more difficult to "accidentally" activate RV devices 14, making it much less likely that an errant electrical glitch, or outside network message, will "accidentally" enable a feature. It would, for example, be undesirable for electrical noise to "accidentally" start an RV slideout system moving while the RV 18 is on the road. Encryption ensures that remote commands to actuate outputs are not accidental, and it ensures the integrity of the commands themselves.

As shown in FIG. 6, when an RV device 14 receives a security request from an HMI 22, the RV device 14 generates and sends back a random number as shown in action steps 80. The HMI 22 then uses an encryption algorithm to scramble that number as shown in action step 82, and then sends the scrambled number back to the RV device 14. The RV device 14 uses the same encryption algorithm to decode the scrambled number as shown in action step 84. If the RV device 14 sees that the numbers agree, and that no other device has security access at that time, then security access is given to the device as shown in action step 86 (on a first come first serve basis; two devices cannot have simultaneous access). As shown by decision steps 81 and 83, the RV device 14 will only process commands from the device that has security access, and will ignore all others. If the RV device 14 receives a security request from more than one device (HMI 22), the RV device 14 generates and sends random numbers to each. If more than one of the devices (HMIs 22) scrambles and returns its authentication number and the RV device 14 decodes and discovers that more than one of the received decoded numbers are the same ones sent, the RV device 14 will grant security access to the first of the command devices as shown by decision steps 81 and 83. After an HMI's security access request has been received by an RV device 14, and, after the RV device 14 has granted security access to the requesting HMI 22 as shown in action step 86, the requesting HMI 22 then sends control commands to the RV device 14 as shown in action step 88 of FIG. 7 and the RV device 14 executes the commands as shown in action step 90.

Chassis information may also be coupled to any one or more of the HMIs 22 and/or RV devices 14 to disable features for safety-related reasons and/or to improve or enhance performance of a particular RV device 14. For example, an RV device 14 may alter its performance in response to receipt of signals received from, for example, a chassis sensor corresponding to outside air temperature. The gateway module 40 may also interface with a chassis/powertrain localbus 12 of an RV and relay chassis information between one or more of the HMIs 22 and/or an one or more of the other localbus 12 RV devices 14. The RV wireless control system may, for example, prevent slides from extending if an automatic transmission of the RV 18 is out of park or if a parking brake of the RV 18 has not been set. Also an audible alarm may sound if the RV wireless remote control system 10 perceives that the coach is in an unsafe state, e.g., if the system 10 perceives that the RV's parking brake has been released while an awning is in its extended position or is not in its stowed position. Problems may also be indicated on a notification screen of the RV wireless control system 10. The system 10 may also be configured to monitor fireplace temperature and report that information to one or more remote user interface devices. The system 10 may be further configured to allow a user to program a safety shutoff temperature, or enable a fireplace auto-sleep delay timer.

A video intercom system may be incorporated into the RV wireless remote control system 10 and may include a video recording and playback device connected via the system 10 to any number of video sources such as webcams carried in, on, and/or around the RV 18.

The RV wireless remote control system 10 may also be used to control mood lighting with, for example, a tri color LED control, strobe and mood effects, and lighting color control. To enable such control the GUI 24 screen of an HMI may include a button, slider, or other interactive image. control multiple lights. A "master ON/OFF" switch may be displayed on the HMI GUI 24 to allow a user to turn on or off all lights in the RV 18, all lights in the "main living area", or any number of lights in or on any given portion of the RV 18.

In general, one or more computing systems may be used to carry out various aspects of the presently disclosed systems and methods. In one example, the one or more HMIs 22 may each include a computing system that receives input data and instructions from a user, processes the received input in light of stored software and/or data, and transmit output signals to the user and/or other devices such as the RV devices 14 or the like. Conversely, in another example, the computing system may receive input signals from the user and/or other devices or the like, processes the received input signals in light of stored data and software, and transmit output data to the user. The computing system may include, for example, an electrical circuit, an electronic circuit or chip, and/or a computer.

In the computer embodiment, the computing system generally may include memory, a processor coupled to the memory, one or more interfaces coupled to the processor, one or more input devices coupled to the processor, and/or one or more output devices coupled to the processor. Of course, the computing system further may include any ancillary devices, for example, clocks, internal power supplies, and the like. Although not shown, the computing system may be supplied with electricity by an external power supply, for example, an AC to DC transformer, one or more batteries, fuel cells, and the like.

The input devices and output devices may be separate or integrated, and may be used to receive or transmit any suitable user input or output, whether tactile, audible, and/or visual. The input devices may include peripheral input devices or user input devices, for example, a pointing device (e.g., a mouse, trackball, pen, touchy pad, touch screen, joystick, and the like), keyboard, microphone, camera, and/or the like. The input devices may be used to enter any suitable commands, instructions, data, information, signals, and the like into the processor. The output devices may include user output devices, for example, audio speakers or earphones, or a monitor or any other type of display device, or may include peripheral output devices, for example, a printer, a modem or any other communication adapter, and/or the like.

The interfaces may include internal and/or external communication interfaces and may include wired and/or wireless devices. For example, the interfaces may include an internal bus, which may provide for data communication between the processor, memory, and/or other interface elements of the computing system. In another example, the interfaces may include an external bus for data communication between elements of the computing system and peripheral devices. The interfaces may include one or more of any of several types of bus structures, including a memory bus or memory controller, a peripheral bus, an accelerated graphics port, a local or processor bus, and using any of a variety of bus architectures. Also, the interfaces may include analog-to-digital or digital-to-analog converters, signal conditioners, amplifiers, filters, other electronic devices or software modules, and/or any other suitable interfaces. The interfaces may conform to, for example, RS-232, parallel, small computer system interface, universal serial bus, and/or any other suitable protocol(s). The interfaces may include circuits, software, firmware, and/or any other device to assist or enable the computing system in communicating internally and/or externally with other devices.

The processor may process data and execute instructions that provide at least some of the functionality for the various portions of the system. As used herein, the term instructions may include, for example, control logic, computer software and/or firmware, programmable instructions, or other suitable instructions. The processor may include, for example, one or more microprocessors, microcontrollers, discrete logic circuits having logic gates for implementing logic functions on data signals, application specific integrated circuits with suitable logic gates, programmable or complex programmable logic devices, programmable or field programmable gate arrays, and/or any other suitable type of electronic processing device(s).

The memory may include any computer readable storage medium or media configured to provide at least temporary storage of at least some data, data structures, an operating system, application programs, program modules or data, and/or other computer software or computer-readable instructions that provide at least some of the functionality of the system and that may be executed by the processor. The data, instructions, and the like may be stored, for example, as look-up tables, formulas, algorithms, maps, models, and/or any other suitable format.

The memory may be in the form of removable and/or non-removable, volatile memory and/or non-volatile memory. Illustrative volatile memory may include, for example, random access memory (RAM), static RAM (SRAM), dynamic RAM (DRAM) including synchronous or asynchronous DRAM, and/or the like, for running software and data on the processor. By way of example, and not limitation, the volatile memory may include an operating system, application programs, other memory modules, and data. Illustrative non-volatile memory may include, for example, read only memory (ROM), erasable programmable ROM (EPROM), electrically erasable programmable ROM (EEPROM), dynamic read/write memory like magnetic or optical disks or tapes, and static read/write memory like flash memory, for storing software and data. Although not separately shown, the computer may also include other removable/non-removable volatile/non-volatile data storage or media. For example, the other media may include dynamic or static external storage read/write device(s).

The methods or parts thereof can be implemented in a computer program product including instructions carried on a computer readable storage medium for use by one or more processors of one or more computers to implement one or more of the method steps. The computer program product may include one or more software programs comprised of program instructions in source code, object code, executable code or other formats; one or more firmware programs; or hardware description language (HDL) files; and any program related data. The data may include data structures, look-up tables, or data in any other suitable format. The program instructions may include program modules, routines, programs, objects, components, and/or the like. The computer program product can be executed on one computer or on multiple computers in communication with one another.

The program(s) can be embodied on non-transitory computer readable media, which can include one or more storage devices, articles of manufacture, or the like. Example non-transitory computer readable media include computer system memory, e.g. RAM (random access memory), ROM (read only memory); semiconductor memory, e.g. EPROM (erasable, programmable ROM), EEPROM (electrically erasable, programmable ROM), flash memory; magnetic or optical disks or tapes; and/or the like. The non-transitory computer readable storage medium may also include computer to computer connections, for example, via a network or another communications connection (either wired, wireless, or a combination thereof). Non-transitory computer readable media include all computer readable media, with the sole exception of transitory propagating signals. Any combination(s) of the above examples is also included within the scope of the computer-readable media. It is therefore to be understood that the method(s) can be at least partially performed by any electronic articles and/or devices capable of executing instructions corresponding to one or more steps of the disclosed method(s).

An RV wireless remote control system as described above provides a user with convenient control of critical and peripheral RV onboard systems 16 from a single portable device. The RV wireless control system may also be configured to relay critical sensor information that allows the user to remotely survey and respond to the status of critical systems. All of the devices are "networked" together by a physical electrical network installed in an RV (the RV localbus 12 network). This physical electrical network is extended over an RF fieldbus 20 to give devices that are not physically connected to the RV localbus 12, full access to the RV localbus 12.

This description, rather than describing limitations of an invention, only illustrates an embodiment of the invention recited in the claims. The language of this description is therefore exclusively descriptive and is non-limiting. Obviously, it's possible to modify this invention from what the description teaches. Within the scope of the claims, one may practice the invention other than as described above.

What is claimed is:

1. A recreational vehicle (RV) wireless remote control system comprising:

an RV localbus connectable to one or more RV devices (network-enabled, remote-control-enabled electrical devices connected to and configured to operate respective RV onboard systems);

an RF fieldbus wirelessly couplable to the RV localbus;

a Human-Machine Interface (HMI) including:

an HMI dock connector couplable to the RF localbus;

an HMI RF receiver wirelessly couplable to the RF fieldbus, and a Graphic User Interface (GUI) coupled to both the HMI fieldbus RF transceiver and the HMI dock connector, the HMI being configured to generate signals in response to human inputs to the GUI and/or in response to device status messages received from the RV devices over the RV localbus and/or the RF fieldbus, the HMI fieldbus RF transceiver being configured to receive RV device status signals via a wireless connection from the RF fieldbus when the HMI dock connector is not connected to the RV localbus, the HMI dock connector being configured to receive RV device status signals via a wired connection from the RV localbus when the HMI dock connector is connected to the RV localbus, the HMI being configured to generate control signals in response to human operator input signals received via the GUI, and to transmit the control signals to the RV devices over the RF fieldbus via the HMI fieldbus RF transceiver when the HMI dock connector is not connected to the RV localbus, and over the RV localbus via the HMI dock connector when the HMI dock connector is connected to the RV localbus, the HMI being further configured for real time distributive control of the RV devices such that the RV localbus and the RF fieldbus operate in both directions enabling closed-loop control between the HMI and the RV devices; the system further comprising:

a docking station including:

a docking station dock connector that is electrically connectable to the HMI dock connector, and a localbus transceiver coupled between the docking station dock connector and the RV localbus and configured to provide a hard-wired data connection between the HMI and the RV localbus when the HMI dock connector is electrically connected to the docking station dock connector; and the system further comprising:

a communications gateway module including:

a gateway localbus transceiver that is coupled to the RV localbus via a hardwired connection;

a gateway fieldbus RF transceiver that is coupled to the RF fieldbus; and a gateway controller coupled to the gateway localbus transceiver and the gateway fieldbus RF transceiver and programmed to use bridge/routing algorithms to forward messages received over the RV localbus onto the RF fieldbus, and to forward messages received over the RF fieldbus onto the RV localbus.

2. An RV wireless remote control system as defined in claim 1 in which the RV devices may comprise any one or more devices selected from the group of devices consisting of a leveler control, a slide-out control, a TV lift control, a fireplace control, an awning control, a tire pressure monitoring system (TPMS) control, a solar power system control, water/fuel tank monitor control, a water tank heater control, a water pump control, an internal/external lighting control, a rear view backup camera control, a chassis gateway control, a compass control, a generator control, an air conditioning system control, a stove-top lift control, a furnace control, a stove control and/or status monitor, a refrigerator control and/or status monitor, a chassis air bag control, a motorized step control, an RV power distribution control, or a shore power/recharge control.

3. An RV wireless remote control system as defined in claim 1 in which the RV localbus is configured to operate according to the CAN standard.

4. An RV wireless remote control system as defined in claim 1 in which the HMI comprises one or more features selected from the group of features consisting of a capacitive touch screen, ZigBee® capable, Bluetooth® capable, WiFi® capable, 315 MHz capable, docking station support, forward and rear facing cameras, speaker, microphone, SD card slot, USB connection for recharging, or accelerometer and/or gyroscope for tracking and dead reckoning.

5. An RV wireless remote control system as defined in claim 1 in which the gateway module comprises one or more features selected from the group of features consisting of WiFi® capability, Bluetooth® capability, ZigBee® capability, 315 MHz capability, CAN bus support, GPS support, high bandwidth custom media bus support, HDMI support, or ethernet support.

6. An RV wireless remote control system as defined in claim 1 in which the HMI includes at least one personal tracking unit configured to report its location to the system.

7. An RV wireless remote control system as defined in claim 6 in which the personal tracking unit comprises one or more features selected from the group of features consisting of a GPS, a compass, an accelerometer, a magnetometer.

8. A recreational vehicle (RV) wireless remote control system comprising a Human-Machine Interface (HMI) including:

an HMI RF receiver;

an HMI dock connector; and a Graphic User Interface (GUI) coupled to both the HMI RF transceiver and the HMI dock connector, the GUI being configured to generate signals in response to human inputs to the GUI and/or in response to status signals received from other devices connected to a local RV wired network and/or to an RF fieldbus, the HMI RF transceiver being configured to receive RV device status signals over a wireless connection from an RF fieldbus when the HMI dock connector is not connected to the RV localbus, the HMI dock connector being configured to receive RV device status signals over a wired connection from the RV localbus when the HMI dock connector is connected to the RV localbus, the HMI being configured to generate control signals in response to human operator input signals received via the GUI, and to transmit the control signals to the RV devices over the RF fieldbus via the HMI RF transceiver when the HMI dock connector is not connected to the RV localbus, and over the RV localbus via the HMI dock connector when the HMI dock connector is connected to the RV localbus, the HMI being further configured for real time distributive control of the RV devices such that the RV localbus and the RF fieldbus operate in both directions enabling closed-loop control between the HMI and the RV devices.

9. An RV wireless remote control system as defined in claim 8 in which the system includes:

a docking station comprising a docking station dock connector electrically connectable to the HMI dock connector, and a localbus transceiver coupled between the docking station dock connector and the RV localbus and configured to provide a hard-wired data connection between the HMI and the RV localbus when the HMI dock connector is electrically connected to the docking station dock connector.

10. An RV wireless remote control system as defined in claim 9 in which the HMI includes a rechargeable battery and the docking station is connected to an electrical power source and is configured to charge the HMI battery when the HMI is docked in the docking station.

11. An RV wireless remote control system as defined in claim 9 in which the docking station includes a lock configured to secure the HMI to the docking station and preclude unauthorized removal.

12. An RV wireless remote control system as defined in claim 8 in which the system includes a communications gateway module comprising:

a gateway localbus transceiver that is coupled to the RV localbus;

a gateway fieldbus RF transceiver that is coupled to the RF fieldbus; and a gateway controller coupled to the gateway localbus transceiver and the gateway fieldbus RF transceiver and programmed to use bridge/routing algorithms to forward messages received over the RV localbus onto the RF fieldbus, and to forward messages received over the RF fieldbus onto the RV localbus.

13. An RV wireless remote control system as defined in claim 8 in which the RV devices may comprise any one or more devices selected from the group of devices consisting of a leveler control, a slide-out control, a TV lift control, a fireplace control, an awning control, a tire pressure monitoring system (TPMS) control, a solar power system control, water/fuel tank monitor control, a water tank heater control, a water pump control, an internal/external lighting control, a rear view backup camera control, a chassis gateway control, a compass control, a generator control, an air conditioning system control, a stove-top lift control, a furnace control, a stove control and/or status monitor, a refrigerator control and/or status monitor, a chassis air bag control, a motorized step control, an RV power distribution control, or a shore power/recharge control.

14. An RV wireless remote control system as defined in claim 8 in which the RV localbus is configured to operate according to the CAN standard.

15. An RV wireless remote control system as defined in claim 8 in which the HMI comprises one or more features selected from the group of features consisting of a capacitive touch screen, ZigBee® capable, Bluetooth® capable, WiFi® capable, 315 MHz capable, docking station support, forward and rear facing cameras, speaker, microphone, SD card slot, USB connection for recharging, or accelerometer and/or gyroscope for tracking and dead reckoning.

16. An RV wireless remote control system as defined in claim 8 in which the gateway module comprises one or more features selected from the group of features consisting of WiFi® capability, Bluetooth® capability, ZigBee® capability, 315 MHz capability, CAN bus support, GPS support, high bandwidth custom media bus support, HDMI support, or ethernet support.

17. An RV wireless remote control system as defined in claim 8 in which the HMI includes at least one personal tracking unit configured to report its location to the system.

18. An RV wireless remote control system as defined in claim 17 in which the personal tracking unit comprises one or more features selected from the group of features consisting of a GPS, a compass, an accelerometer, a magnetometer.

19. An RV wireless remote control system as defined in claim 8 in which:

the HMI is programmed to precede a control command to an RV device, with a security request;

at least one RV device is programmed to respond to receipt of the security request from the HMI by generating and sending back a random number to the HMI;

the HMI is programmed to use an encryption algorithm to scramble the number, and then send the scrambled number back to the RV device;

the RV device is programmed to decode the scrambled number and, if the numbers agree, to grant security access to the HMI.

20. An RV wireless remote control system as defined in claim 19 in which the RV device is programmed to grant security access to only the first device from which the RV device receives a scrambled number that the RV device is then able to decode and match with a number sent by the RV device in response to a security request.

* * * * *